United States Patent [19]

Gallatin

[11] 4,078,220

[45] Mar. 7, 1978

[54] CONTACTOR HAVING MEANS TO INHIBIT CONTACT WELDING CAUSED BY JAMMING OF THE ARMATURE

[75] Inventor: Paul M. Gallatin, Brookfield, Wis.

[73] Assignee: Allis-Chalmers Corporation, Milwaukee, Wis.

[21] Appl. No.: 754,575

[22] Filed: Dec. 27, 1976

[51] Int. Cl.[2] ..... H01F 7/08

[52] U.S. Cl. ..... 335/270; 335/276; 200/302

[58] Field of Search ..... 335/270, 271, 276, 277; 200/302

[56] References Cited

U.S. PATENT DOCUMENTS

| | | | |
|---|---|---|---|
| 2,374,017 | 4/1945 | Iglehart et al. | 335/276 |
| 2,471,181 | 5/1949 | Wilson | 335/276 X |
| 3,389,354 | 6/1968 | Ahlberg | 335/277 |

*Primary Examiner*—George Harris
*Attorney, Agent, or Firm*—Lee H. Kaiser

[57] ABSTRACT

The contacts of a DC contactor operating in a contaminated atmosphere are prevented from welding as a result of jamming of the armature by a thin nonmagnetic shim which is mounted on the armature so that it is disposed in the closed magnetic circuit and retains a dirt-shielding gasket above the armature pivot area so that falling dirt cannot accumulate between armature and yoke where it might, absent the gasket, interfere with closing of the armature and thus result in reduced contact pressure and increased heating of the contacts.

4 Claims, 3 Drawing Figures

CONTACTOR HAVING MEANS TO INHIBIT CONTACT WELDING CAUSED BY JAMMING OF THE ARMATURE

This invention relates to electric contact devices such as electromagnetic relays and DC contactors.

BACKGROUND OF THE INVENTION

Electromagnetic relays and contactors operating in contaminated atmospheres occasionally experience welding of the contacts over a period of time in use. This problem may result from mounting of the device so that a clapper armature is disposed in a vertical plane and is mounted for pivotal movement about a line of engagement with a straight edge of the magnetic yoke in a manner which permits falling dust and dirt to collect in the armature pivot area. The dirt may accumulate to the point where interference occurs between the armature and the edge of the yoke and prevents the armature from closing completely, and such interference may result in loss of contact pressure, increased contact heating and welding of the contacts. Further, such accumulation of dirt adjacent the armature pivot area may cause the pivoted end of the armature to move in a direction away from the yoke during closing rather than pivoting about the line of engagement with the yoke. Such undesired movement of the pivoted end of the armature may introduce a high reluctance air gap in the magnetic circuit which accentuates the problems of increased contact heating and welding of the contacts.

OBJECTS OF THE INVENTION

It is an object of the invention to provide an improved electromagnetic circuit controlling device such as a DC contactor which obviates the above defects and disadvantages of prior art devices and reduces the possibility of welding of the contacts as a result of accumulation of falling dust and dirt in the armature pivot area.

SUMMARY OF THE INVENTION

An electromagnetically actuated circuit controlling device embodying the invention has a thin nonmagnetic shim affixed to the armature and disposed in the closed magnetic circuit of the device, and the shim retains a dirt-shielding gasket above the armature pivot area to prevent falling dirt and dust particles from accumulating between yoke and armature where such particles might, absent the gasket, jam the armature and thus cause reduced contact pressure and increased heating of the contacts.

DESCRIPTION OF THE DRAWINGS

The above and other objects and advantages of the invention will be more readily apparent from the following detailed description when considered together with the accompanying drawing wherein.

DETAILED DESCRIPTION

Figure 1:
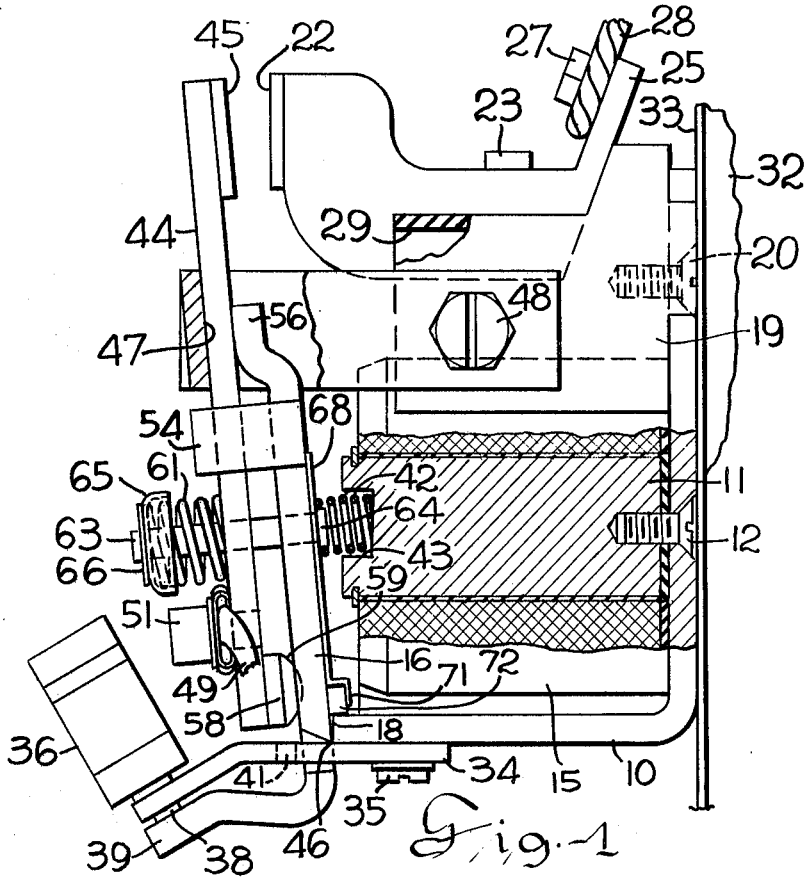
FIG. 1 is a front view, partly in section, of a DC contactor embodying the invention.
Figure 2:
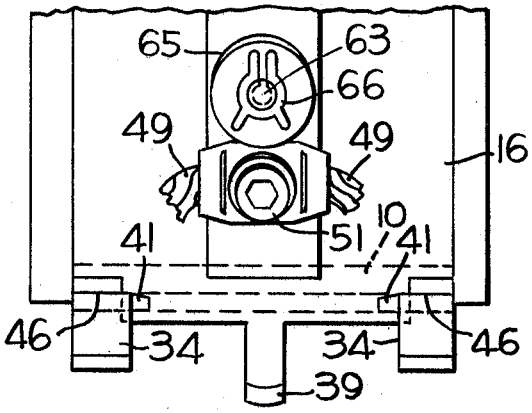
FIG. 2 is a partial side view of the contactor shown in FIG. 1.
Figure 3:
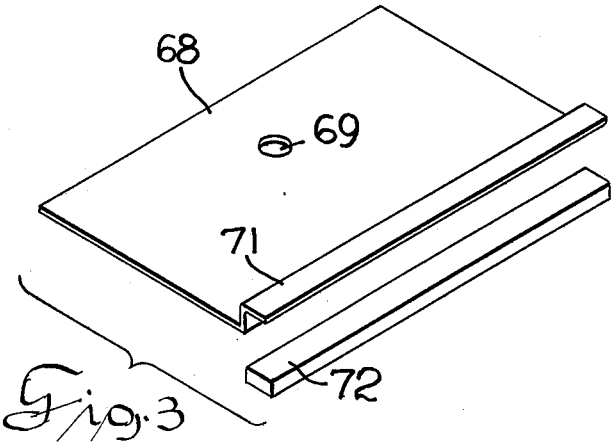
FIG. 3 is a perspective view of the nonmagnetic shim and the dirt-shielding gasket held in place by the shim.

Referring to the drawing, the invention is illustrated as embodied in a circuit controlling electromagnetic device such as a known DC contactor having a generally L-shaped ferromagnetic yoke 10, a cylindrical ferromagnetic core 11 affixed to yoke 10 by a screw 12, an energizing magnet coil 15 surrounding core 11, and a ferromagnetic clapper armature 16 pivotally mounted in line engagement with a straight edge 18 of yoke 10 for movement between circuit opening and closing position. A stationary contact insulating block 19 may be affixed to yoke 10 by a screw 20. A stationary contact 22 of high conductivity metal such as copper is affixed to insulating block 19 by a screw 23 and may have an inclined terminal portion 25 provided with a threaded aperture (not shown) adapted to receive a bolt 27 for securing a flexible conductor 28. Insulating block 19 may have apertures 29 therethrough which receive mounting screws (not shown) for mounting the contactor against the vertical wall of a support 32 with a sheet of insulation 33 disposed between the yoke 10 and support 32.

An armature retainer 34 is secured to yoke 10 by screws 35. A known commercially available limit switch 36 having any desired arrangement of contacts may be mounted on retainer 34 and may have a projecting operating pin 38 which is actuated inwardly by a tail 39 on armature 16 to operate the limit switch contacts when armature 16 is moved to closed position. Shoulders 46 on armature 16 abut against retainer 34 to prevent downward longitudinal translation of armature 16 relative to yoke 10, and shoulders 41 on retainer 34 interfere with and limit movement of the pivoted end of armature 16 in a direction away from edge 18 of yoke 10.

A helical compression return spring 42 having one end disposed in an axial opening 43 in core 11 reacts between armature 16 and core 11 and urges armature 16 toward open position.

An elongated flat contact carrier bar 44 is mounted on armature 16 so that they move together. Bar 44 carries a movable contact button 45 which engages stationary contact 22 when armature 16 closes. A limit stop 47 affixed to insulating block 19 by a screw 48 is in interfering relation with contact carrier bar 44 and limits movement of armature 16 in the opening direction. In alternative embodiments the limit stop may be U-shaped and carry a contact button (not shown) which cooperates with a contact button on the upper face of bar 44 (not shown) to form a pair of normally closed contacts.

A pair of flexible leads 49 may be affixed at one end to contact carrier bar 44 by a bolt 51 and secured at the other end to yoke 10 by a screw (not shown).

Contact carrier bar 44 is mounted on armature 16 so that they move together as a unit until movable contact 45 engages stationary contact 22, after which armature 16 pivots relative to bar 44 during further travel, or overtravel, of armature 16 until it engages core 11. A pair of projecting ears 54 on armature 16 disposed on opposite sides of contact carrier bar 44 limit lateral movement of bar 44 relative to armature 16. An upwardly projecting portion 56 of armature 16 engages bar 44 adjacent movable contact button 45 and urges bar 44 in circuit opening direction under the force of return spring 42.

A pivot member 58 disposed between the tail end of contact carrier bar 44 and armature 16 has a round surface 59 which fits within a complementary groove in armature 16 to permit relative pivotal movement between bar 44 and armature 16 so armature 16 can continue to travel after contacts 45 and 22 engage. A pre-loaded helical contact pressure spring 61 urges contact carrier bar 44 toward armature 16 and tends to prevent contact bounce during armature overtravel. A guide pin 63 having a head 64 positioned beneath armature 16 extends through clearance holes in armature 16 and in bar 44 and projects axially through contact pressure spring 61. A cup-shaped member 65 fits over the end of spring 61, and a snap ring 66 is engaged within a circumferential groove (not shown) in guide pin 63 to maintain spring 61 in pre-loaded condition.

Overtravel of armature 16, after contacts 22 and 45 engage, pulls guide pin 63 in a direction to further load contact pressure spring 61, and the force of pre-loaded spring 61, together with that resulting from momentum of the armature, is exerted against contact carrier bar 44 in a direction to increase contact pressure and thus prevent contact bounce.

Welding, or freezing, of contacts 22 and 45 of known contactors such as described above occasionally occurs when they are operated under contaminated conditions. Such problem may at least partially be due to dirt and dust falling on the contactor and accumulating in the armature pivot area between the edge 18 of yoke 10 and the opposing surface of the armature between which line engagement exists. We have found that such accumulation of dirt and dust particles may jam, i.e., interfere with complete closing of, armature 16 and that such interference may result in loss of contact pressure between contacts 22 and 45, increased heating of these contacts, and consequent welding of the contacts. Further, we have found that such accumulation of dirt in prior art devices occasionally caused the pivoted end of armature 16 to move away from yoke edge 18 during closing movement rather than pivoting about the line of engagement therebetween, and such lifting of the pivoted end of armature 16 relative to the yoke edge 18 introduced a relatively high reluctance air gap into the magnetic circuit and resulted in reduced contact pressure and change in operating characteristics.

In accordance with the present invention, such defects and disadvantages of prior art circuit controlling devices are overcome by a thin (e.g., 0.010 thick) nonmagnetic shim 68, preferably of square configuration, mounted on armature 16 so shim 68 is disposed between core 11 and armature 16 in the closed magnetic circuit of the contactor. A clearance hole 69 is provided in shim 68 for guide pin 63, and head 64 of pin 63 fits beneath shim 68 and holds it against armature 16 under the force of the contact pressure spring 61. Nonmagnetic shim 68 introduces a high reluctance gap into the closed magnetic circuit through core 11 which tends to prevent residual magnetism from retaining the armature in the closed position when magnet coil 15 is de-energized. The force of return spring 42 also tends to maintain shim 68 against armature 16. An L-shaped gasket-retaining portion 71 is provided on shim 68 adjacent the armature pivot area, and an elongated dirt-shielding gasket 72 of suitable insulating material such as urethane foam is compressed within portion 71 and against the surfaces of armature 16 and yoke 10. Gasket 72 covers the generally V-shaped opening between yoke edge 18 and armature 16 and thus prevents accumulation of dirt in the armature pivot area where, absent gasket 72, dirt and dust could accumulate and interfere with closing movement of armature 16.

It will be appreciated that the improved results of the invention can also be accomplished if the nonmagnetic shim is affixed by suitable means such as brazing to the armature.

While only a single embodiment of my invention has been illustrated and described, many modifications and variations thereof will be readily apparent to those skilled in the art, and consequently it should be understood that I do not intend to be limited to the particular embodiment shown and described.

The embodiments of the invention in which an exclusive property or privilege is claimed are defined as follows:

1. In an electromagnetically actuated circuit controlling device, a magnetic yoke, a magnetic core affixed to said yoke, an electrical coil surrounding said core, a clapper magnetic armature, means for mounting said armature for pivotal movement about a line of engagement between said armature and said yoke, said armature when in closed position completing, together with said yoke and said core, a closed magnetic circuit, a stationary contact, a movable contact carried by said armature and adapted to engage said stationary contact, return spring means for resiliently biasing said armature toward open position, a thin nonmagnetic shim carried by said armature in a position wherein it is disposed in said closed magnetic circuit between said armature and said core and having a gasket-retaining portion, and a dirt-shielding gasket compressed within said gasket-retaining portion against said armature and covering the opening between the opposed surfaces of said yoke and said armature adjacent said line of engagement to thereby prevent accumulation of foreign particles in said opening.

2. In a circuit controlling device in accordance with claim 1 and including a contact carrier bar, said movable contact being affixed to said contact carrier bar, means for mounting said contact carrier bar on said armature so that they move together relative to said yoke while permitting pivotal movement therebetween after engagement of said movable contact with said stationary contact, said means for mounting said contact carrier bar including pre-loaded contact pressure spring means for urging said contact carrier bar toward said armature, and wherein said shim is held on said armature by the force of said contact pressure spring means.

3. In a circuit controlling device in accordance with claim 2 wherein said contact pressure spring means includes a helical contact spring, and said means for mounting said contact carrier bar includes a tensioned headed guide pin which extends axially through said helical contact pressure spring and also through openings in said contact carrier bar and said armature and holds said contact pressure spring in pre-loaded condition against said contact carrier bar, and wherein the head on said tensioned guide pin holds said shim against said armature.

4. In a contactor having a magnetic yoke, a magnetic core affixed to said yoke, a magnet coil surrounding said core, a stationary contact, a clapper armature, a movable contact carried by said armature and cooperating with said stationary contact, and means for mounting said armature for pivotal movement about a line of engagement between said armature and a straight edge of said yoke, the improvement comprising a thin nonmagnetic shim carried by said armature in a position wherein it is disposed in the closed magnetic circuit through said yoke, said core and said armature, said shim having a gasket-retaining portion adjacent said line of engagement, and a dirt-shielding gasket compressed within said gasket-retaining portion and against said armature and covering the opening formed between said straight edge and said armature when said armature is in open position and preventing foreign particles from accumulating in said opening.

* * * * *